US006285854B1

(12) United States Patent
Obata et al.

(10) Patent No.: US 6,285,854 B1
(45) Date of Patent: Sep. 4, 2001

(54) IMAGE RECORDING APPARATUS

(75) Inventors: Shigeru Obata, Ishioka; Hidefumi Ohtsuka, Ibaraki-ken; Shuho Yokokawa, Mito; Isao Nakajima; Akitomo Kuwabara, both of Hitachinaka, all of (JP)

(73) Assignees: Hitachi, Ltd., Tokyo; Hitachi Koki Co., Ltd., Tokyp, both of (JP)

( * ) Notice: Subject to any disclaimer, the term of this patent is extended or adjusted under 35 U.S.C. 154(b) by 0 days.

(21) Appl. No.: 09/481,977

(22) Filed: Jan. 13, 2000

(30) Foreign Application Priority Data

Jan. 13, 1999 (JP) ..... 11-005979

(51) Int. Cl.[7] ..... G03G 15/00
(52) U.S. Cl. ..... 399/384; 399/68; 399/400
(58) Field of Search ..... 399/384, 68, 397, 399/400, 306, 322; 226/28; 101/178, 179

(56) References Cited

U.S. PATENT DOCUMENTS 4,110,027 * 8/1978 Sato et al. ..... 399/317
5,189,470 * 2/1993 Matsuda et al. ..... 399/68
5,785,440 * 7/1998 Nishikawa et al. ..... 399/384 X
6,055,408 * 4/2000 Creutzmann et al. ..... 399/384
6,101,347 * 8/2000 Rokutanda et al. ..... 399/400 X

FOREIGN PATENT DOCUMENTS 5-158309 * 6/1993 (JP) .
5-310351 * 11/1993 (JP) .
8-050382 * 2/1996 (JP) .
8-262821 * 10/1996 (JP) .

* cited by examiner

*Primary Examiner*—Sophia S. Chen
(74) *Attorney, Agent, or Firm*—Antonelli, Terry, Stout & Kraus, LLP

(57) ABSTRACT

An image recording apparatus for recording a two-color image on both surfaces of a continuous recording medium includes a toner image recording portion which has a toner carrier and transfers a toner image formed on a surface of the toner carrier onto the recording medium, a tractor for feeding the recording medium on which the toner image is transferred, and a both side fixing machine for receiving the recording medium fed by the tractor to fix the toner image transferred on the recording medium. In this image recording apparatus, guide rollers come into contact with non-printing portions on both side ends of the recording medium to apply tension to the recording medium by a spring and thereby gives a predetermined slack to the recording medium to absorb a difference in speed resulted between the tractor and the both side fixing machine.

6 Claims, 6 Drawing Sheets

IMAGE RECORDING APPARATUS

BACKGROUND OF THE INVENTION

The present invention relates to an image recording apparatus, and more particularly to an image recording apparatus for recording an image on a continuous recording medium such as paper, a sheet type plastic film and the like.

Various kinds of image recording apparatus for recording an image on a continuous paper have been developed. For example, the image recording apparatus is provided with an image recording portion for actually performing printing on the continuos paper. As a printing mode in this image recording portion, an impact mode using a wire or a hammer and a non-impact mode represented by an electrophotographic mode are known.

As a method for feeding the continuous paper, there are two methods, i.e., a method using feed perforations and a frictional feed method using a roller. In the feed method using the feed perforations, a plurality of pins are fitted in the feed perforations formed on the continuous paper. These pins are provided on the belt surface of a tractor having a rotary driving portion. When the belt of the tractor is rotationally driven, the continuous paper is given a feeding force.

When the image recording portion performs image printing (development and transfer printing in practice) on the continuous paper to which the feed perforations are formed by the electrophotographic mode, the continuous paper is fed to a fixing part by the tractor. In the fixing part, the image on the continuous paper is stabilized by carrying out a fixing process.

In general, the fixing part is provided with a heating roller and a pressure roller at an inside thereof. The continuous paper is sandwiched between these rollers and drawn from an image recording portion to the inside of the fixing part. Thus, when the continuous paper is fed from the image recording portion to the fixing part by the tractor, disadvantages such as slack or cutoff of the continuous paper is resulted if a large difference in speed between the tractor and the both rollers in the fixing part occurs.

For example, JP-A-8-50382 discloses that tension is applied to the continuous paper to absorb the abovementioned difference in speed in order to prevent these problems from occurring. This publication discloses a plate which pivotally comes into contact with the entire area of the back surface of the continuous paper in order to apply the tension to the continuous paper. A pivot position of the plate is adjusted. Since only printing on one surface of the continuous paper is described in this prior art, an unfixed image is not distorted even if the plate is brought into contact with the entire area of the back surface opposed to the printed surface.

However, in this prior art, when trying to print on the both surfaces of the continuous paper, since the plate is brought into contact with the entire area of the back surface of the continuous paper, the unfixed image is distorted and a normal result cannot be obtained. Since the need for printing a multi-color image or a full-color image on both surfaces has been increased in recent years, the technique disclosed in this prior art is not sufficient. Further, in this prior art, the plate is simply brought into contact with the continuous paper, and therefore, there is also a problem that the continuous paper tends to be displaced in the width direction thereof.

Further, as another prior art, there is JP-A-5-310351. In this prior art, disclosed is a technique that a continuous paper is printed by a laser printer and then in an after processing device, the printed continuous paper is cut into sheets of a predetermined size to be stacked. In this case, a roller which floats on the continuous paper stretching between two fixed rollers is provide in order to absorb a difference between a feeding speed in the laser printer and a fetching speed in the after processing device, and the continuous paper is given a slack, thereby absorbing the difference in speed. Since the continuous paper has been already fed out from the laser printer, fixation of an image formed on the continuous paper is already completed. Typically, a tractor and a fixing part are provided in the inside of the laser printer. This prior art does not clearly disclose means for solving problems which may occur when there is a difference in speed between the tractor and the fixing part.

SUMMARY OF THE INVENTION

Therefore, a subject matter of the present invention is to provide an image recording apparatus capable of obtaining an excellent printing result on both surfaces of a continuous recording medium such as paper, a sheet type plastic film and the like.

To achieve the subject matter, an image recording apparatus of the present invention comprises: image recording means, having a toner carrier, for transferring a toner image formed on a surface of the toner carrier onto a continuous recording medium; feeding means for feeding the recording medium having the toner image transferred thereon; and fixing means for fixing the toner image on the recording medium fed by the feeding means, wherein there is provided speed difference absorbing means for giving predetermined slack to the recording medium by coming into contact with non-printing portions on both side ends of the recording medium to apply tension to the recording medium and for absorbing a speed difference generated between the feeding means and the fixing means.

According to this structure, the speed difference absorbing means applies tension in a direction substantially vertical to a feeding direction for the recording medium to impart predetermined slack to the recording medium. In this case, the speed difference absorbing means comes into contact with the non-printing portions of the recording medium on the both side ends to apply tension. Consequently, even if unfixed toner images exist on both surfaces of the recording medium, the toner images cannot be distorted, thereby obtaining excellent recorded images after fixation.

The speed difference absorbing means is provided with a guide roller which comes into contact with the nonprinting portion of the recording medium on the both side ends and rotates as the recording medium is fed, and the guide roller is characterized by being capable of moving in the vertical direction. According to this structure, a slack quantity of the recording medium is adjusted by that the guide roller in contact with the recording medium moves in the vertical direction, and a speed difference generated between the feeding means and the fixing means can be thereby absorbed.

Further, in an image recording medium having the same structure as described above, the present invention is characterized by comprising: a guide roller which is provided between the feeding means and the fixing means and gives predetermined slack to the recording medium by coming into contact with a non-printing portion of the recording medium on both side ends to apply tension to the recording medium; detecting means for detecting a position of said guide roller; and controlling means for controlling a feeding speed for the recording medium in such a manner that the detected position of the guide roller is in a predetermined range.

According to this structure, the guide roller moves in a direction substantially vertical to the feeding direction for the recording medium to apply tension to the recording medium, and at this time a position of the guide roller is detected by the detecting means. A slack quantity of the recording medium can be obtained by detecting the position of the guide roller in this way. As a result, it is possible to indirectly grasp a speed difference generated between the feeding means and the fixing means. Additionally, the controlling means controls a feeding speed for the recording medium in such a manner that the position of the guide roller is in a predetermined range, namely, the speed difference is eliminated.

The guide roller is provided with restricting means for restricting the position of the recording medium in the width direction. The restricting means may be a flange portion provided on outer peripheries of the guide roller or pins which are provided on outer peripheries of the guide roller and fitted in the feed perforations of the recording medium.

DESCRIPTION OF THE PREFERRED EMBODIMENTS

The preferred embodiments according to the present invention will now be described hereinafter with reference to the accompanying drawings.

(Embodiment 1)

The overall structure of an image recording apparatus according to the present invention will now be described with reference to FIG. 1.

Figure 1:
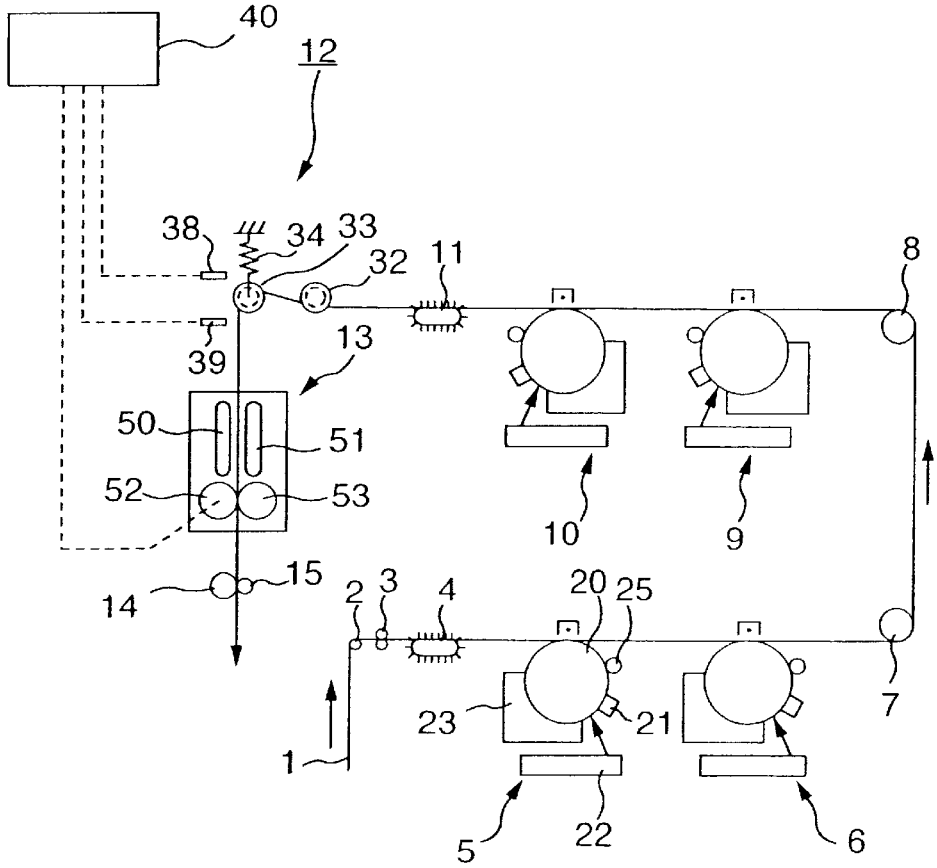
FIG. 1 is a schematic structural view of a two-color lase printer for both side according to an embodiment 1 of the present invention.

As shown in FIG. 1, auxiliary rollers 2 and 3, a tractor 4, toner image recording portions 5 and 6, guide rollers 7 and 8, toner image recording portions 9 and 10, a tractor 11, a speed difference absorbing mechanism 12, a both side fixing machine 13, and ejection rollers 14 and 15 are arranged along a direction of feeding a continuous recording medium 1 such as a paper, a sheet type plastic film and the like.

Although not illustrated, the recording medium 1 is rolled before printing. Further, feed perforations are formed on both side end portions along the feeding direction.

Each of the tractors 4 and 11 has a belt with pins. When these pins are fitted in the feed perforations of the recording medium 1 and the belt is rotationally moved, the tractors 4 and 11 can feed the recording medium 1. The toner image recording portions 5, 6, 9 and 10 are so arranged as to form images on both surfaces of the recording medium 1. For example, the toner image recording portions 5 and 6 form an image on a first surface (front surface) of the recording medium 1 whilst the toner image recording portions 9 and 10 form an image on a second surface (back surface) of the recording medium 1. Image forming areas in which images are formed on the first and second surfaces are areas except the above-described both side end portions. These image forming areas are defined by a user of the image forming apparatus or the size of the toner image recording portions 5 and 6. The both side end portions require the width in which at least the feed perforations can be formed.

In each of the toner image recording portions 5, 6, 9 and 10, a photosensitive material drum 20 in which a photosensitive material layer is applied on a surface of a metal drum is rotatably provided. Around the photosensitive material drum 20, the following components are provided: a charger 21 for uniformly charging the surface of the photosensitive material drum 20; an optical system 22 for forming an electrostatic latent image on the photosensitive material drum 20; a development unit 23 for manifesting the electrostatic latent image using the toner to form a toner image; a transfer corotron 24 for transferring the toner image onto the recording medium 1; and a drum cleaner 25 for removing the residual toner on the photosensitive material drum 20 after transferring. Incidentally, although reference numerals of the charger 21, the optical system 22, the development unit 23, the transfer corotron 24 and the drum cleaner 25 are given only in the toner image recording portion 5, the toner image recording portions 6, 9 and 10 have the similar configuration.

The both side fixing machine 13 is constituted by preheaters 50 and 51 for preheating the toner image formed on both surfaces of the recording medium 1 and heat rollers 52 and 53 for fixing the toner image on the recording medium 1. It is desirable to apply the present invention to an apparatus provided with a fixing machine for fixing the toner images formed on both surfaces of the recording medium 1 all at once. The detail of the speed difference absorbing mechanism 12 will be described later.

The recording medium 1 having passed the auxiliary rollers 2 and 3 is fed to the toner image recording portions 5 and 6 by the tractor 4. During the recording medium 1 passes through the toner image recording portions 5 and 6, a two-color transfer image is formed on the first surface of the recording medium 1. Subsequently, after the feeding direction is inverted by the guide rollers 7 and 8, a two-color transfer image is formed on the second surface of the same during the recording medium 1 passes through the toner image recording portions 9 and 10. The recording medium 1 having the transfer images formed on the first and second surfaces, i.e., the both surfaces by the toner image recording portions 5, 6, 9 and 10 is fed to the speed difference absorbing mechanism 12 and the both side fixing machine 13 by the tractor 11.

The detail of the speed difference absorbing mechanism 12 will be described with reference to FIGS. 2 and 3.

This speed difference absorbing mechanism 12 absorbs a difference in speed between the tractor 11 and the both side fixing machine 13. It is to be noted that the tractors 4 and 11 are driven by the same motor and a difference in speed is not generated between them.

Figure 2:
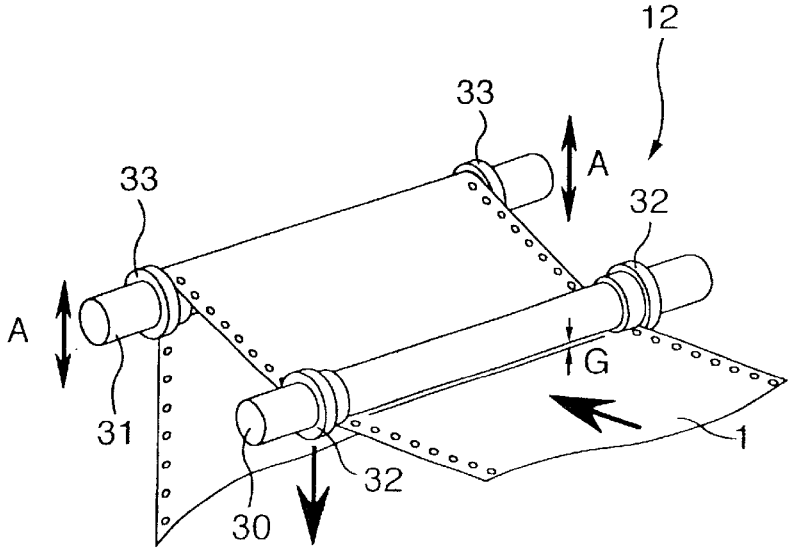
FIG. 2 is a perspective view of a speed difference absorbing mechanism set in the laser printer of FIG. 1.

As shown in FIG. 2, in the speed difference absorbing mechanism 12, shafts 30 and 31 are set along the feeding direction for the recording medium 1. The guide rollers 32 are provided to the both end sides of the shaft 30. Guide rollers 33 are provided on the both end sides of the shaft 31. Here, the shaft 30 is fixed and does not move. The shaft 31 is suspended by a spring 34 (see FIG. 1) and capable of moving in a direction indicated by arrows A in the drawing.

Figure 3:
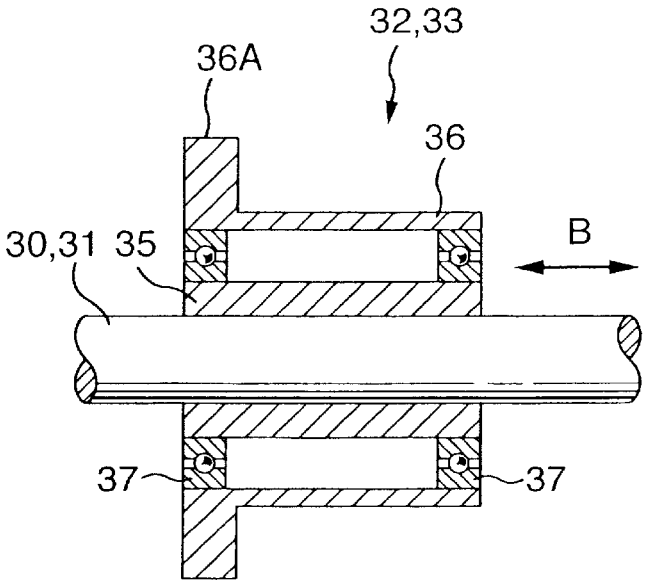
FIG. 3 is a cross-sectional view of a guide roller used in the speed difference absorbing mechanism of FIG. 2.
Figure 4:
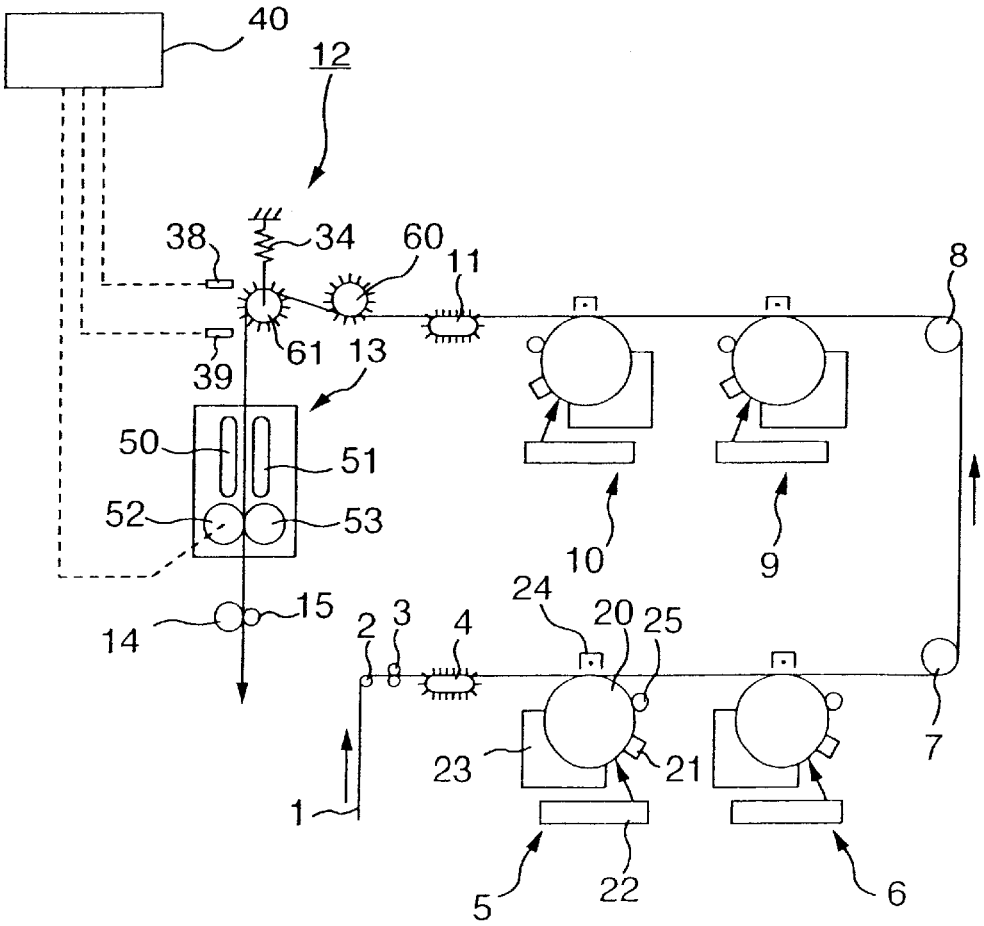
FIG. 4 is a schematic structural view of a two-color laser printer for both side printing according to an embodiment 2 of the present invention.

The cross section of the guide roller 32, 33 is shown in FIG. 3. The guide roller 32, 33 is constituted by the following components: carriers 35 each having a cylindrical shape; paper guide portions 36 each of which also has a cylindrical shape and has a flange 36A on one side thereof; and ball bearings 37 provided between the carriers 35 and the paper guide portions 36. The shaft 30, 31 is fitted in the carriers 35. The carriers 35 are not fixed to the shaft 30, 31 and capable of moving on the shaft 30, 31 in a direction indicated by arrows B in the drawing. Further, since the ball bearings 37 are provided between the carriers 35 and the paper guide portions 36, the paper guide portions 36 can rotate around the shaft 30, 31.

As shown in FIG. 2, after the recording medium 1 passes under the shaft 30, the feeding direction of the recording medium 1 is changed to a downward direction at the shaft 31. Here, only the both side end portions which are the non-printing portions of the recording medium 1 are in contact with the paper guide portions 36 of the guide roller 32, 33 so that a gap G is formed between the recording medium 1 and the shaft 30, 31. It is to be noted that only the gap G between the recording medium 1 and the shaft 30 is shown in FIG. 2. On account of the gaps G formed between the shafts 30, 31 and the recording medium 1, the unfixed toner images are not distorted when a difference in feeding speed of the recording medium 1 between the toner image recording portion 10 and the both side fixing machine 13 is eliminated.

The recording medium 1 having the toner images formed on both surfaces thereof by the toner image recording portions 5, 6, 9 and 10 is fed to the speed difference absorbing mechanism 12 and further fed to the both side fixing machine 13 by the tractor 11. The tractor 11 and the both side fixing machine 13 are driven by independent drive systems respectively, and hence a speed difference is generated between them. If there is no means for absorbing the speed difference, the slack is generated in the recording medium 1 when the feeding speed of the tractor 11 is faster, and the recording medium 1 is cut off when the feeding speed of the fixing machine 13 is faster. In this embodiment, since the shaft 31 is suspended by the spring 34 and the recording medium 1 is led to the guide rollers 33 provided on the shaft 31, the tension is applied from the spring 34 to the recording medium 1 so that slack is resulted. By the slack generated to the recording medium 1, it is possible to absorb a difference in speed between the tractor 11 and the both side fixing machine 13.

The "slack" in this embodiment is formed when the tension of the recording medium 1 supported by the shaft 31 through the guide rollers 33 and the tension of the spring 34 are balanced under the condition that the image forming areas of the recording medium 1 do not come into contact with the shafts 30 and 31.

Further, although the unfixed toner images are formed on both surfaces of the recording medium 1, the unfixed toner images can not be distorted because the guide rollers 32 and 33 are brought into contact with only the non-printing portions of the recording medium 1 on both ends where no toner image is formed.

Furthermore, since the flanges 36A are formed to the paper guide portions 36 of the guide rollers 32, 33, the displacement of the recording medium 1 in the width direction during feeding can be suppressed, and the recording medium 1 can be stably fed from the speed difference absorbing mechanism 12 to the both side fixing machine 13. In addition, as shown in FIG. 3, the guide rollers 32 is moveable on the shaft 30 and the guide rollers 33 is moveable on the shaft 31 in the direction indicated by arrows B. Therefore, the present invention can cope with recording mediums 1 having different widths.

As shown in FIG. 1, the speed difference absorbing mechanism 12 is provided with sensors 38 and 39 for detecting a position of the guide roller 33. The sensor 38 detects an upper limit position of the guide rollers 33 and the sensor 39 detects a lower limit position of the guide rollers 33. Detected signals of the sensors 38 and 39 are input to a controller 40, and the controller 40 controls the rotating speed of heat rollers 52 and 53 of the both side fixing machine 13 based on the detection signals from the sensors 38 and 39. That is, when the rotating speed of the heat rollers 52 and 53 becomes slower than the feeding speed of the tractor 11, the slack of the recording medium 1 becomes large, and hence the guide rollers 33 are moved upwardly by a force of the spring 34. When the guide rollers 33 are raised to the upper limit position, the sensor 38 detects them. In this case, the controller 40 controls to increase the rotating speed of the heat rollers 52 and 53 based on the detection signal from the sensor 38.

On the other hand, when the rotating speed of the heat rollers 52 and 53 becomes faster than the feeding speed of the tractor 11, the slack of the recording medium 1 becomes small, and hence the guide rollers 33 are moved downwardly against the force of the spring 34. When the guide rollers 33 are moved to the lower limit position, the sensor 39 detects them. In this case, the controller 40 controls to decrease the rotating speed of the heat rollers 52 and 53 based on the detection signal from the sensor 39. In this manner, it becomes possible to control the guide rollers 33 to be positioned between the upper limit position and the lower limit position. By controlling the rotating speed of the heat rollers 52 and 53 of the both side fixing machine 13 in such a manner that the guide rollers 33 are settled at a predetermined position, the speed difference of the recording medium 1 can be absorbed without causing the unfixed toner images to be brought into contact with the shafts 30 and 31.

(Embodiment 2)

A embodiment 2 according to the present invention will now be described.

Figure 5:
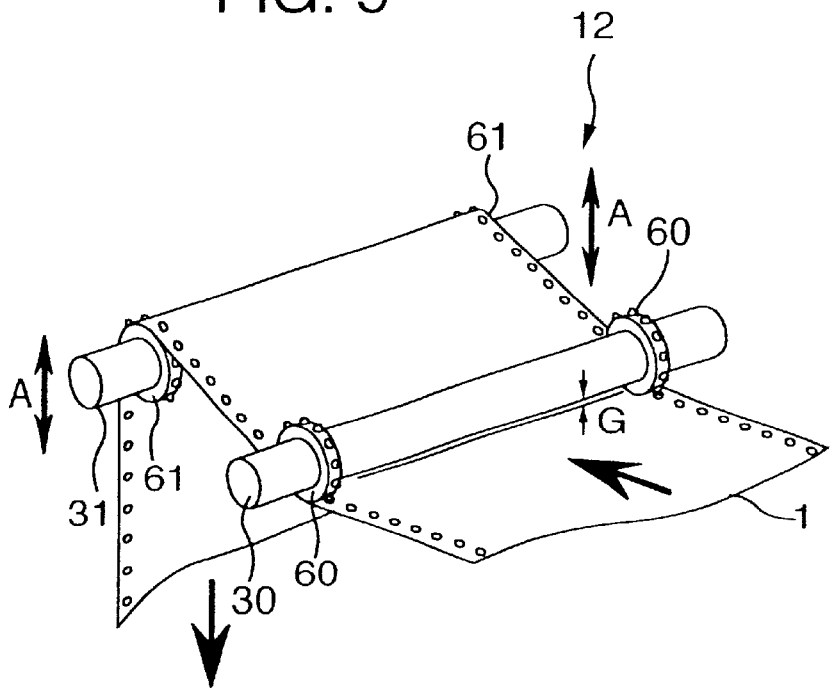
FIG. 5 is a perspective view of a speed difference absorbing mechanism set in the laser printer of FIG. 4.
Figure 6:
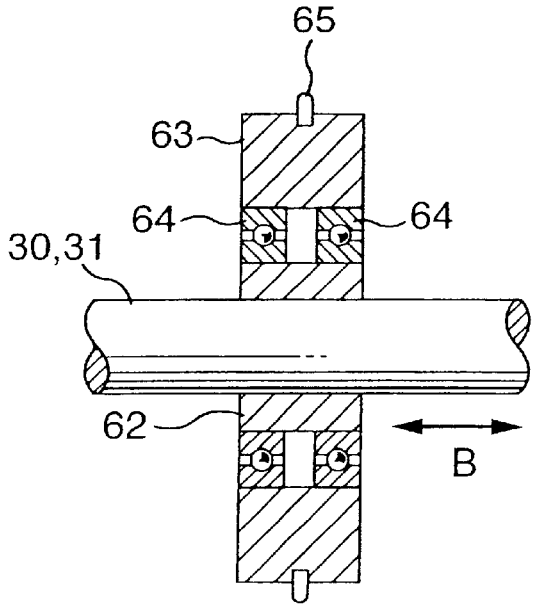
FIG. 6 is a cross-sectional view of a guide roller used in the speed difference absorbing mechanism of FIG. 5.

In this embodiment, as shown in FIG. 5, guide rollers 60 and 61 provided on the both end sides of the shaft 30, 31 of the speed difference absorbing mechanism 12 have pins. These pins are fitted in the feed perforations of the recording medium 1. That is, as shown in FIG. 6, the guide rollers 60 and 61 include a cylindrical carrier 62, a cylindrical resin roller 63 disposed on the outside of the carrier 62 and ball bearings 64 provided between the carrier 62 and the roller 63. A plurality of pins 65 are embedded in an outer peripheral surface of the roller 63 at equal intervals so that the pins 65 are fit into the feed perforations of the recording medium 1.

The shaft 30, 31 is fitted into the carrier 62. The carrier 62 is not fixed to the shaft 30, 31 and can move on the shaft 30, 31 freely in the direction of the arrows B in the drawing in accordance with the width of the recording medium 1. In addition, since the ball bearings 64 are provided between the carrier 62 and the roller 63, the roller 63 can rotate around the shaft 30, 31.

According to this structure, as shown in FIG. 5, only the both side end portions which are the non-printing portions of the recording medium 1 come into contact with the outer peripheral surface of the rollers 63 of the guide rollers 60 and 61, and a gap G is formed between the recording medium 1 and the shaft 30, 31. This can prevent the unfixed toner image formed on the both surfaces of the recording medium 1 from being distorted.

As similar to the embodiment 1, the shaft 31 is suspended by the spring 34. Therefore, the tension is applied from the spring 34 to the recording medium 1 when passing the guide rollers 61, so that slack is generated. According to this slack, the difference in speed between the tractor 11 and the both side fixing machine 13 can be absorbed.

Moreover, because the pins 65, which fit into the feed perforations of the recording medium 1, are formed on the outer peripheral surface of the roller 63 of the guide rollers 60 and 61, the displacement of the recording medium 1 in the width direction during feeding is suppressed, and the recording medium 1 can be stably fed from the speed difference absorbing mechanism 12 to the both side fixing machine 13. Particularly, in this embodiment, since the pins 65 are fit into the feed perforations of the recording medium 1, the displacement quantity of the recording medium 1 in the width direction can be suppressed to a value equal to or below 0.2 mm (average) which is a difference in diameter between the feed perforation and the pin, and the recording medium 1 can be fed to the both side fixing machine 13 with high accuracy.

Similarly, also in this embodiment, when the controller 40 for controlling the rotating speed of the heat rollers 52 and 53 of the both side fixing machine 13 based on the detection signals from the sensors 38 and 39 for detecting a position of the guide roller 61 is provided as shown in FIG. 1, the speed difference between the tractor 11 and the both side fixing machine 13 can be controlled in an appropriate range.

(Embodiment 3)

An embodiment 3 according to the present invention will now be described.

Figure 7:
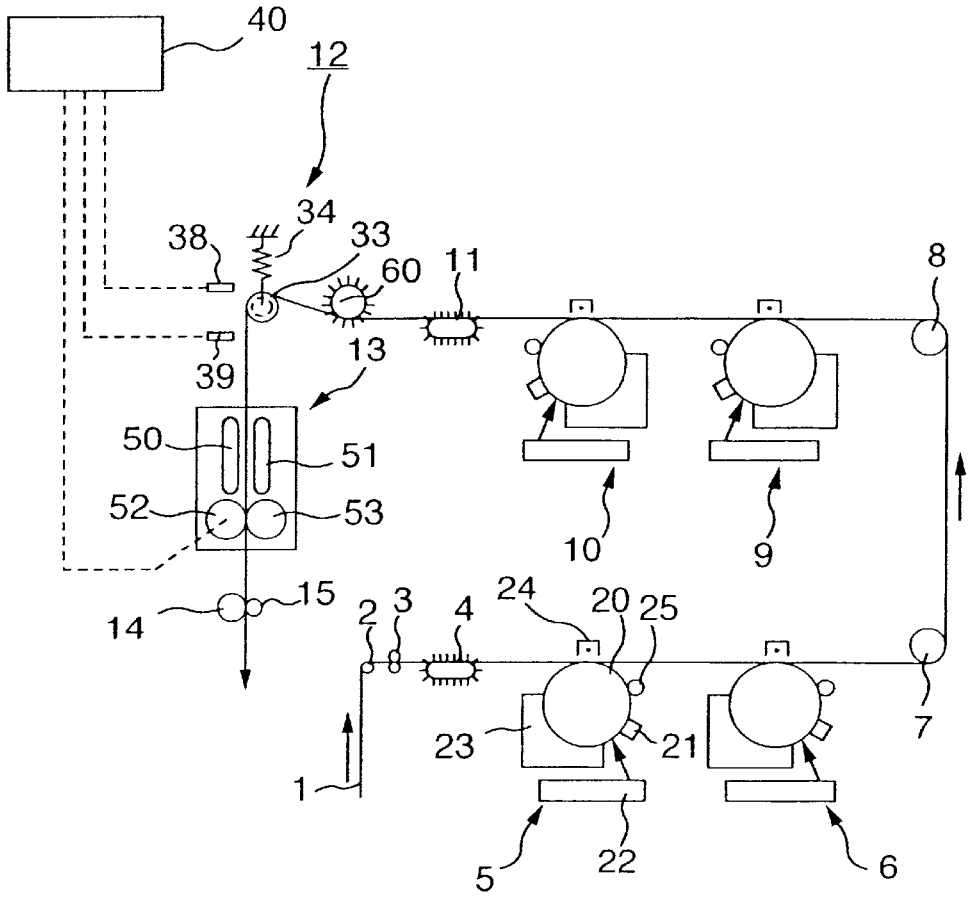
FIG. 7 is a schematic structural view of a two-color laser printer for both side printing according to an embodiment 3 of the present invention.
Figure 8:
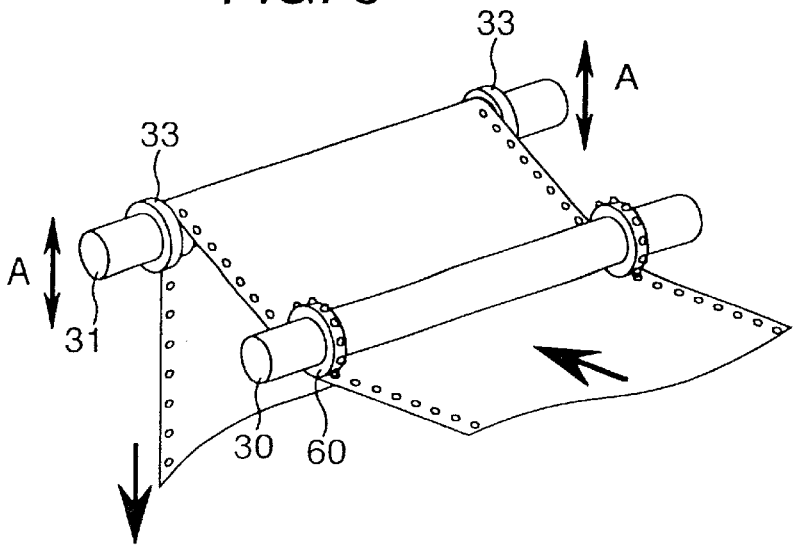
FIG. 8 is a perspective view of a speed difference absorbing mechanism set in the laser printer of FIG. 7.

FIG. 7 shows a schematic structure of a two-color laser printer for both side printing according to the embodiment 3, and FIG. 8 is a perspective view of a speed difference absorbing mechanism set in the laser printer illustrated in FIG. 7.

In this embodiment, as shown in FIG. 8, the guide rollers 60 described in connection with the embodiment 2 are provided on both end sides of the shaft 30 and the guide rollers 33 described in the embodiment 1 are provided on both end sides of the shaft 31, respectively.

In this embodiment, the operational advantages similar to those obtained in the embodiments 1 and 2 can be expected.

(Embodiment 4)

An embodiment 4 according to the present invention will now be described.

Figure 9:
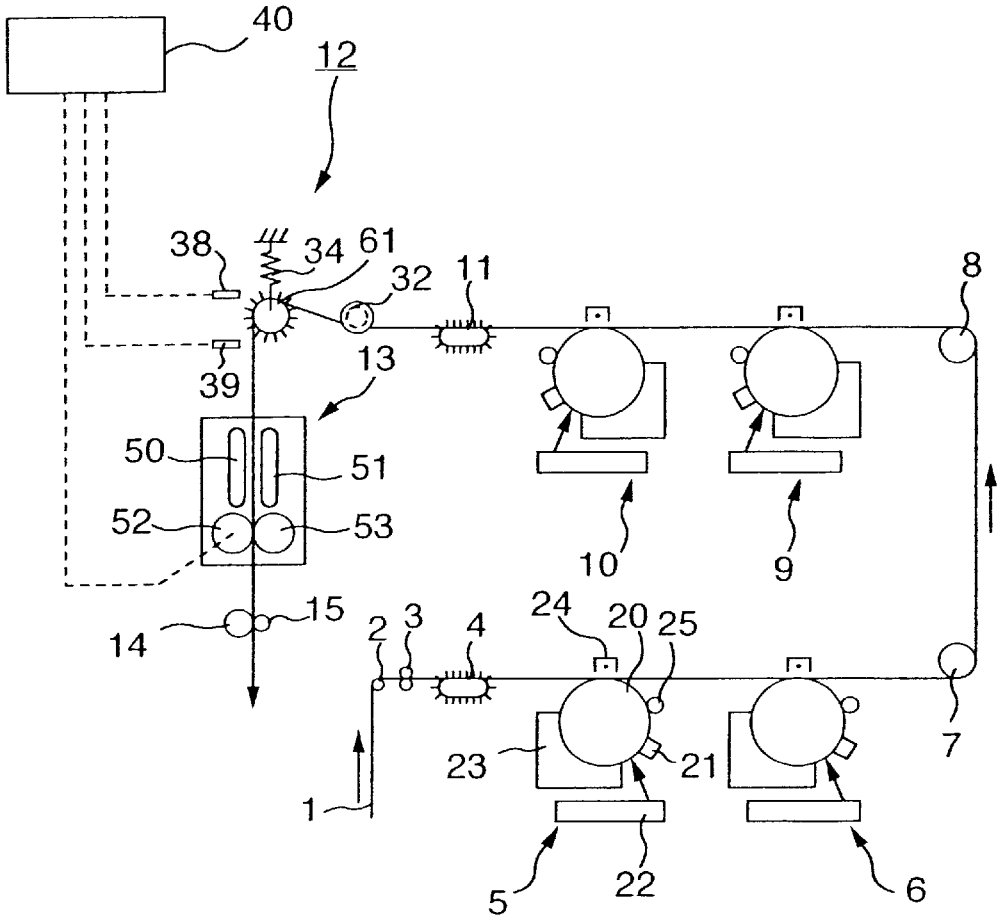
FIG. 9 is a schematic structural view of a two-color laser printer for both side printing according to an embodiment 4 of the present invention.
Figure 10:
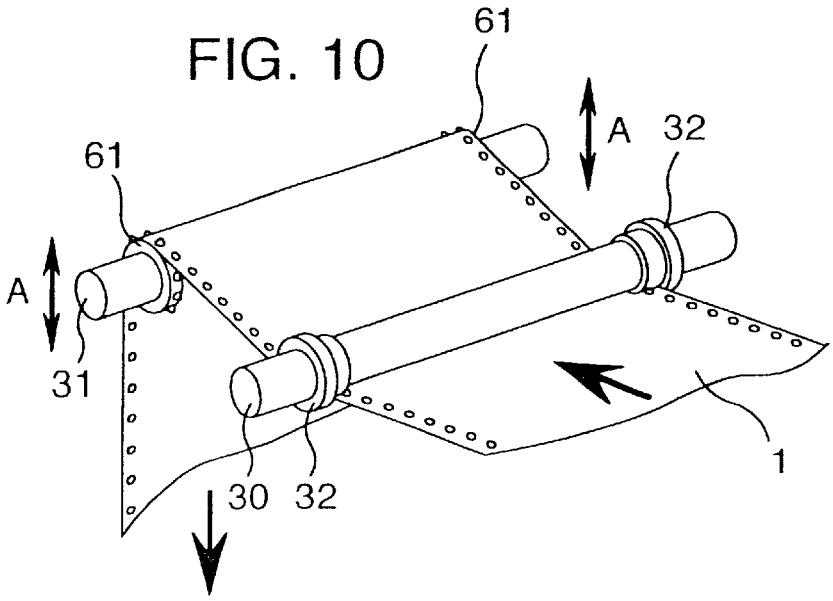
FIG. 10 is a perspective view of a speed difference absorbing mechanism set in the laser printer of FIG. 9.

FIG. 9 shows a schematic structure of a two-color laser printer for both side printing according to the embodiment 4, and FIG. 10 is a perspective view of a speed difference absorbing mechanism set in the laser printer shown in FIG. 9.

In this embodiment, as shown in FIG. 10, the guide rollers 32 described in the embodiment 1 are provided on both end sides of the shaft 30 and the guide rollers 61 described in the embodiment 2 are provided on both end sides of the shaft 31 respectively, and the types of the guide rollers are contrary to those in the embodiment 3.

In this embodiment, the operational advantages similar to those obtained in the embodiments 1 and 2 can be expected.

Description will now be given to a mechanism for moving in the direction A the guide rollers 33 and 61 shown in the above embodiments 1 to 4.

Figure 11:
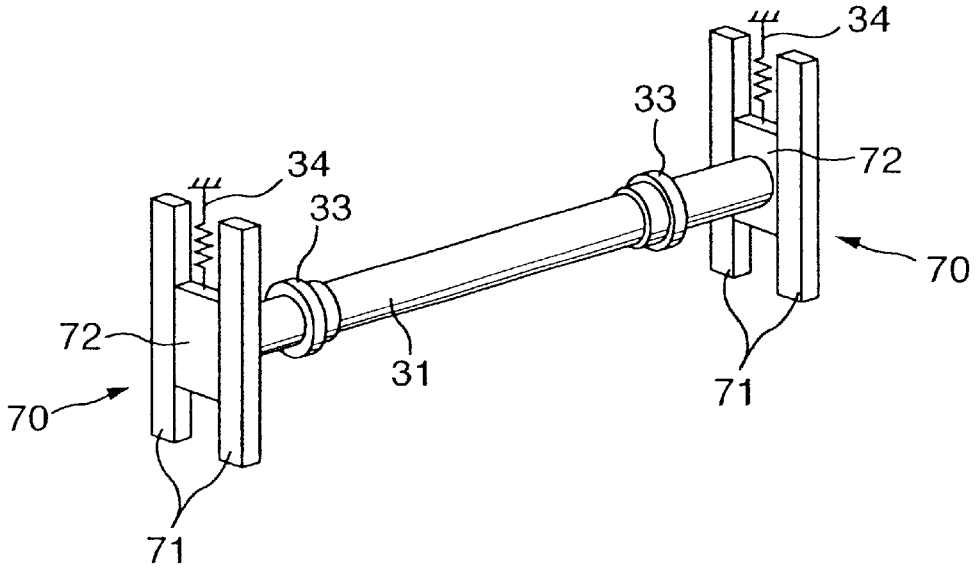
FIG. 11 is a perspective view showing a mechanism for supporting the guide rollers for vertical movement.

As shown in FIG. 11, a pair of bearing units 70 are provided on both end portions of the shaft 31 having the guide rollers 33. In the bearing unit 70, two bars 71 are provided in the vertical direction, and a movable plate 72 is provided between the bars 71 for slide in the vertical direction. The both ends of the shaft 31 are fixed to the movable plate 72 and the spring 34 is connected to an upper portion of the movable plate 72. With this arrangement, the shaft 31 can smoothly move in the vertical direction while being supported by the two bearing units 70 on both sides, and the guide rollers 33 can also move in the direction A.

Figure 12:
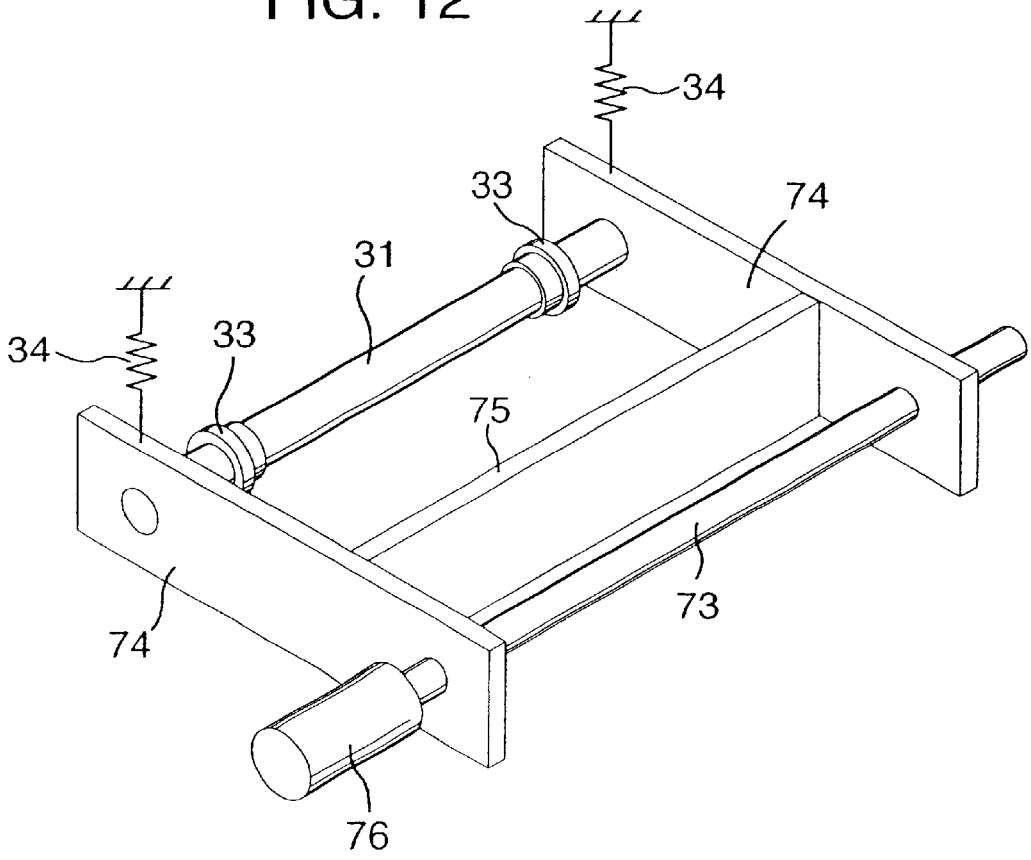
FIG. 12 is a perspective view showing another mechanism for supporting the guide rollers for vertical movement.

Further, a mechanism such as shown in FIG. 12 can be also used. In this example, arms 74 capable of pivoting around a shaft 73 are provided, and the shaft 31 having the guide rollers 33 is mounted to the end portions of the arms 74. Further, a bar 75 for locating the arms 74 on both sides is fixed between the arms 74. The springs 34 are attached to the end portions of the arms 74. With this structure, the shaft 31 can move in the substantially vertical direction around the shaft 73 while being supported by the arms 74, and the guide rollers 33 can also move in the direction A.

Incidentally, in the example of FIG. 12, a sensor 76 for detecting an angle of rotation of the shaft 73 may be provided to the end portion of the shaft 73 in order to control a speed difference between the tractor 11 and the both side fixing machine 13 based on a detection signal from the sensor 76. In place of using the springs 34, spiral springs may be disposed to both end portions of the shaft 73 so that the shaft 31 and the guide rollers 33 are pivotally supported by the spiral spring.

Further, although the guide roller 33 having the flange portion has been described in connection with FIGS. 11 and 12, the similar structure can be obtained when the guide roller 61 having the pins is provided to the shaft 31.

As described above, according to the present invention, since the speed difference absorbing means only comes into contact with the non-printing portion of the both side ends of the recording medium, even if the unfixed toner images exist on the both surfaces of the recording medium, these toner images are not distorted and the excellent recorded images can be obtained after fixation.

Additionally, since the restricting means for restricting a position of the recording medium in the width direction is provided, a displacement quantity of the recording medium in the width direction can be suppressed to a minimum value, thereby realizing the highly accurate feeding mechanism for the recording medium.

What is claimed is:

1. An image recording apparatus comprising: image recording means, which has a toner carrier, for transferring a toner image formed on a surface of said toner carrier onto a continuous recording medium; feeding means for feeding said recording medium having said toner image transferred thereon; fixing means for fixing said toner image on said recording medium fed by said feeding means; and speed difference absorbing means for giving a predetermined slack to said recording medium to absorb a difference in speed generated between said feeding means and said fixing means by coming into contact with non-printing porti[6]ns on both side ends of said recording medium to apply tension to said recording medium.

2. An image recording apparatus according to claim 1, wherein said speed difference absorbing means is provided with guide rollers which come into contact with non-printing portions on both side ends of said recording medium to rotate in association with feeding of said recording medium and said guide rollers are moveable in a vertical direction.

3. An image recording apparatus comprising: image recording means, which has a toner carrier, for transferring a toner image formed on a surface of said toner carrier onto a continuous recording medium; feeding means for feeding said recording medium having said toner image transferred thereof; fixing means for fixing said toner image on said recording medium fed by said feeding means; guide rollers, provided between said feeding means and said fixing means, for giving a predetermined slack to said recording medium by coming into contact with non-printing portions on both side ends of said recording medium to apply tension to said recording medium; detecting means for detecting a position of said guide rollers; and controlling means for controlling a speed for feeding said recording medium in such a manner that a detected position of said guide rollers is in a predetermined range.

4. An image recording apparatus according to claim 2 or 3, wherein said guide rollers are provided with restricting means for restricting a position of said recording medium in a width direction.

5. An image recording apparatus according to claim 4, wherein said restricting means is a flange portion provided on an outer periphery of said guide rollers.

6. An image recording apparatus according to claim 4, wherein said restricting means is pins which are provided on an outer peripheral surface of said guide rollers and fit into feed perforations of said recording medium.

* * * * *